United States Patent [19]

List et al.

[11] 4,130,057

[45] Dec. 19, 1978

[54] DAMPENING SYSTEM FOR PRINTING PRESSES, PARTICULARLY OFFSET PRINTING PRESSES

[75] Inventors: Klaus List, Wachtersbach; Paul Abendroth, Offenbach am Main, both of Fed. Rep. of Germany

[73] Assignee: Roland Offsetmaschinenfabrik Faber & Schleicher AG., Germany

[21] Appl. No.: 856,635

[22] Filed: Dec. 2, 1977

Related U.S. Application Data

[63] Continuation-in-part of Ser. No. 844,907, Oct. 25, 1977, abandoned.

[51] Int. Cl.[2] ..... B41L 25/16

[52] U.S. Cl. ..... 101/148; 101/352

[58] Field of Search ..... 101/148, 349, 350, 351, 101/352

[56] References Cited

U.S. PATENT DOCUMENTS

| | | | |
|---|---|---|---|
| 3,603,254 | 9/1971 | Siebke | 101/148 |
| 3,688,694 | 9/1972 | Preuss | 101/148 |
| 3,749,011 | 7/1973 | Abendroth et al. | 101/148 |
| 3,757,689 | 9/1973 | Koch et al. | 101/148 |

*Primary Examiner*—J. Reed Fisher

*Attorney, Agent, or Firm*—Leydig, Voit, Osann, Mayer & Holt, Ltd.

[57] ABSTRACT

A dampening system for a lithographic printing press which includes, in series, a driven fountain roller, an adjustable intermediate roller, a driven distributor roller, and an adjustable form roller, the latter engaging the printing plate, the intermediate and form rollers being mounted upon respective throw-off levers. A single actuator is used, connected to the form roller throw-off lever. The intermediate roller throw-off lever is effectively in the path of final movement of the form roller throw-off lever, for throw-off by the latter, so that upon subsequent restoration to working position a water path is completed progressively through all of the rollers starting with the fountain roller, and with the form roller touching the plate last, thereby to insure, regardless of the length of the period of throw-off, that the form roller will be wetted to proper degree, free of either flooding or starvation, before being applied to the plate. It is one of the features of the invention that the reaction force of the intermediate throw-off lever against the form roller throw-off lever, upon throw-off, acts through the center of rocking movement of the latter so that the actuator does not have to resist the reaction force. In the preferred form of the invention pressureless "kissing" contact is retained between the intermediate roller and the fountain roller and between the distributor roller and the form roller under the condition of throw-off to insure that the residual moisture on the surfaces of the latter does not contract into droplets.

2 Claims, 4 Drawing Figures

PRESSURE CONTACT BETWEEN ALL ROLLERS

DAMPENING SYSTEM FOR PRINTING PRESSES, PARTICULARLY OFFSET PRINTING PRESSES

This is a continuation-in-part of U.S. application Ser. 844,907 filed Oct. 25, 1977 and now abandonded.

In the applicant's own prior U.S. Pat. No. 3,749,011, which issued July 31, 1973, there is disclosed a dampening system including a fountain roller, intermediate roller, distributor roller and form roller in which the form and intermediate rollers are mounted upon separate levers for control of throw-off by separate actuators. It is found that as a result of lack of coordination of the two throw-off mechanisms it is possible to have either too much or too little dampening fluid on the form roller when it is reapplied to the plate. Thus, where the second actuator is delayed following throw-off of the first, it is possible for excess water to be built up on the distributor roller resulting in the possibility of flooding of the plate with water when the form roller is promptly reapplied. Conversely, after a long period of throw off, during which the dampening fluid has evaporated from the rollers, any delay in restoring the second actuator to working position after the first, runs risk that the form roller may be in substantially dry condition when it is applied to the plate, resulting in undesired pick-up of ink from the plate and tending to degrade the function of the form roller when the regular water flow is finally re-established. Coordinating the operation of the throw-off levers under all possible conditions has required a large amount of manipulative skill.

Moreover, adjusting means are provided in the prior patent for adjusting the degree of engagement of the various rollers in the system, but such adjusting mechanism has been found to be relatively expensive and unnecessarily complex. Finally, it is found that residual moisture on the surfaces of the rollers during throw-off tends to contract into droplets which show up in the subsequently printed product.

It is, accordingly, an object of the present invention to provide an improved system of the above type which is relatively simple and foolproof in operation employing a single actuator for pressure-disengagement of all of the rollers in a predetermined throw-off sequence and for restoring the rollers to working position in converse sequence, with each sequence being accomplished automatically and out of the press operator's control so that each roller, upon being backed-off from the remaining rollers and subsequently re-engaged has deposited thereon precisely the right amount of water with the form roller neither in flooding or starving condition at the time it is re-applied to the plate. It is a more specific object to provie a dampening system which is capable of immediately re-establishing moisture conditions for optimum printing regardless of whether the period of throw-off is short or long. Thus, in the case of momentary throw-off the amount of moisture left on the individual rollers as they are thrown-off in sequence corresponds substantially to the running condition so that when the running condition is re-established promptly the dampening system can take up where it left off. However, under conditions where the period of throw-off has been so long as to permit evaporation of the moisture from the rollers, the sequencing of roller re-engagement is such that the water path is completed through the rollers starting at the fountain roller, with the form roller engaging the plate as a last step, thereby to insure that the form roller will be rewetted to the proper degree before being applied to the plate.

Thus, stated in other terms, it is an object of the invention to provide a dampening system in which the form roller and intermediate roller are mounted upon separte throw-off levers with the intermediate roller throw-off lever being effectively in the path of final movement of the form roller throw-off lever, thereby insuring that intermediate roller throw-off occurs last during the throw-off movement and first during restoration.

It is another object of the invention to provide a dampening system which includes a biasing spring for biasing of the rollers into working position and which includes a single power actuator for the throw-off, the biasing spring being so arranged that the reaction force thereof following throw-off need not be resisted by the actuator, permitting use of an actuator of the type which is capable of generating only momentary thrust for throwing into the opposite condition.

It is yet another object of the present invention, in its preferred form, to provide a dampening system including fountain, intermediate, distributor and form rollers in which, under the condition of throw-off, pressureless "kissing" contact is retained between the intermediate roller, and the fountain roller and between the distributor roller and the form roller, to insure that residual moisture on the surfaces of the rollers does not contract into droplets affecting the quality of the printed product.

Other objects and advantages of the invention will become apparent upon reading the attached detailed description and upon reference to the drawings, in which.

While the invention has been described in connection with a preferred embodiment, it will be understood that we do not intend to be limited to the embodiment shown but intend, on the contrary, to cover the various alternative and equivalent constructions included within the spirit and scope of the appended claims.

Figure 1:
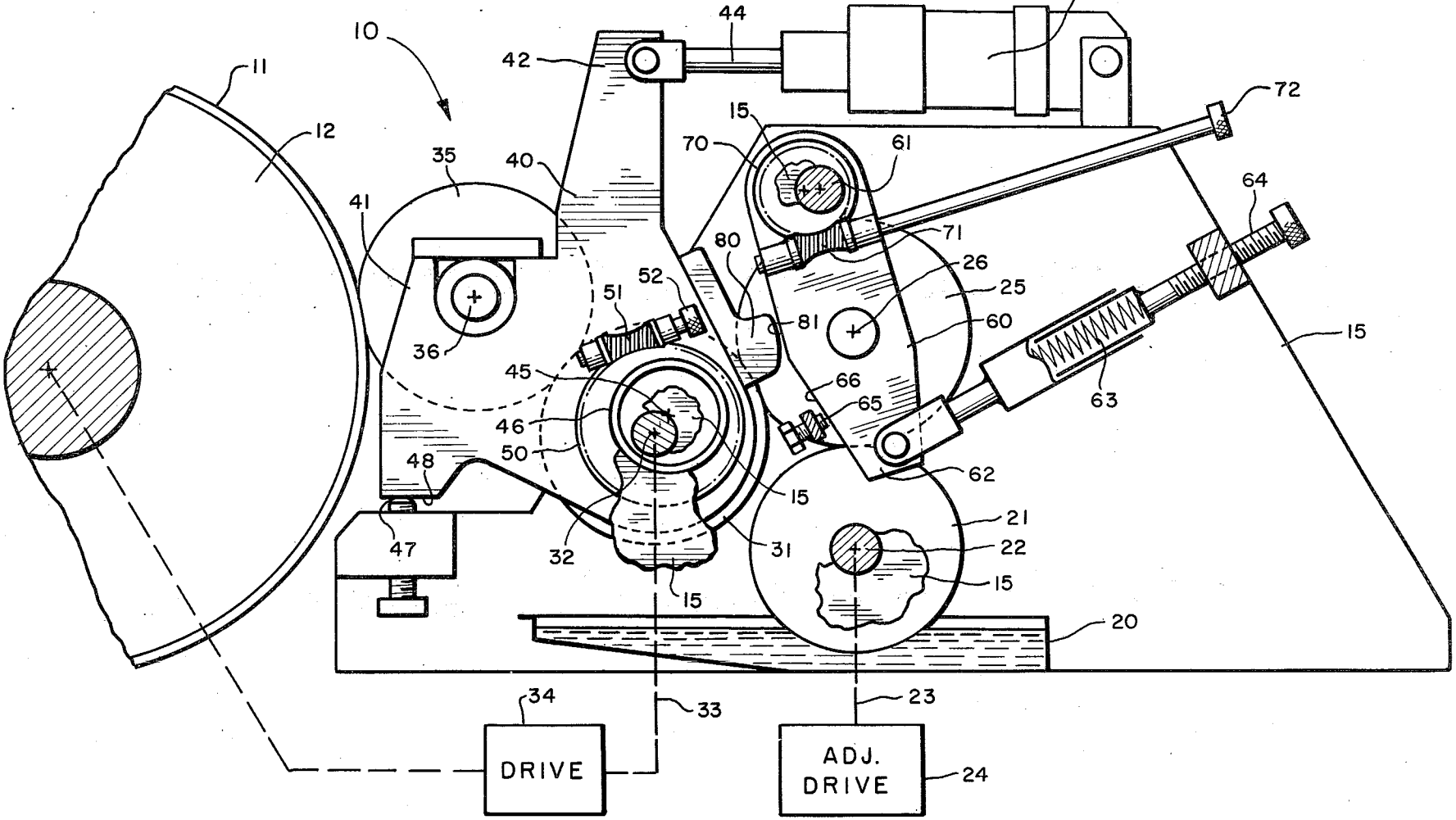
FIG. 1 is an elevational view of a dampening system constructed in accordance with the present invention, partly diagrammatic, and with the parts in normal working position.

Turning now to FIG. 1, there is disclosed a dampening system, or mechanism, 10 for the purpose of applying a film of water or equivalent dampening fluid to a lithographic plate 11 secured to plate cylinder 12. The dampening mechanism includes a series of rollers supported between a pair of frame plates 15. In the base of the frame is a trough or fountain 20 which may, for example, contain a charge of water and alcohol. Dipping into the fountain is a fountain roller 21 having a shaft 22 which is journaled in the frame 15 and which has a connection 23 to a separate adjustable slow speed drive 24 which may, for example, consist of an electric motor with a step-down drive train plus means for adjusting the motor speed, a matter well known in the art. The fountain roller 21 is conventionally formed of metal or other hard surfaced material.

Running in engagement with the fountain roller 21 is an intermediate roller 25 having a shaft 26, the intermediate roller, in accordance with conventional practice, being resiliently surfaced. The intermediate roller 25, in turn, engages a distributor roller 31 having a shaft 32 which is fixedly journaled in the frame. The distributor roller 31 is hard surfaced and has a rotary drive connection 33 to the press drive 34. The distributor roller 31, in addition to being driven positively at "press speed", preferably has an associated "vibrating" mechanism (not shown) for periodic reciprocation thereby to improve the distribution of the moisture in the longitudinal direction.

The distributor roller, in turn, is in rolling engagement with a water form roller 35 which is resiliently surfaced and which, finally, applies the film of water to the plate 11. The means for applying a corresponding film of ink to the plate will be understood to be conventional and therefore has not been shown.

In operation, the form roller 35, which is freely rotatable, is rotated at "press speed" by the surface of the distributor roller 31 and by engagement with the printing plate 11. The intermediate roller 25 is also freely rotatable and is driven at "press speed" by the distributor roller. The fountain roller 21 is driven by its drive 24 at a slower speed resulting in slippage between the rollers 21, 25, the degree of slippage being inversely related to the rate at which water is fed from the fountain.

Figure 2:
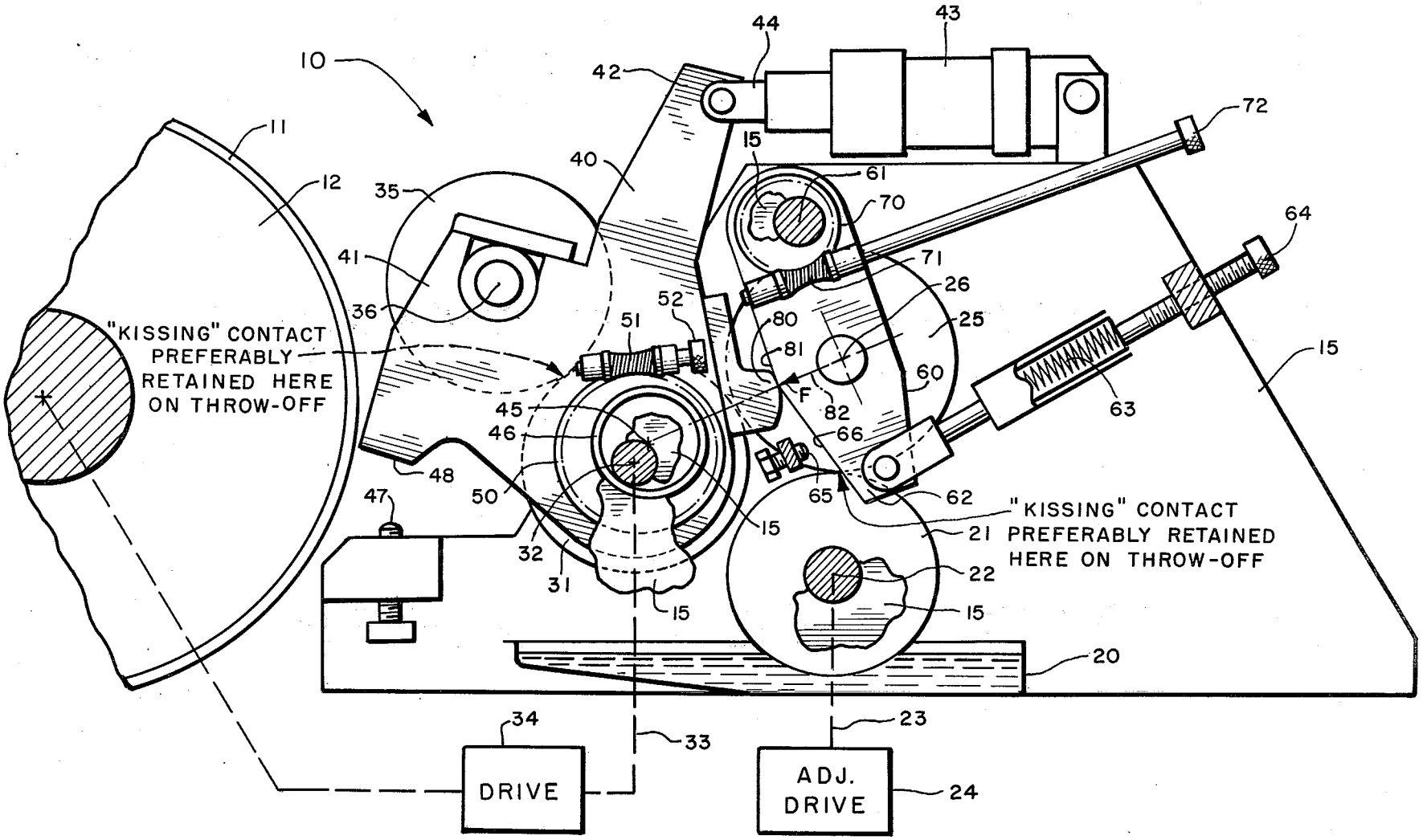
FIG. 2 is a view similar to FIG. 1 but showing the dampening mechanism in the condition of throw-off.

In accordance with the present invention, the form roller 35 and the intermediate roller 25 are mounted on respective throw-off levers for broadwise swinging movement from the pressurized working condition, which is illustrated in FIG. 1, and the throw-off condition, which is illustrated in FIG. 2, in which all of the rollers are out of pressure engagement, with rollers 25 and 31 being completely separated from one another and with the form roller being out of contact with the printing plate, the form roller throw-off lever being operated by a single actuator between its respective positions and the intermediate roller throw-off lever being effectively in the path of final movement of the form roller throw-off lever for actuation by the latter in predetermined sequence. Thus, referring to FIG. 1, the form roller 35, having a shaft 36, is mounted upon a rockable lever 40 having a first arm 41 which carries the roller 35 and a second or actuating arm 42 which is connected to a pneumatic or equivalent actuator 43 having a plunger 44. The lever 40 rocks about an axis 45 centered within a rockable mounting ring 46 which is journaled, as indicated, in the frame 15. The working position of the form roller 35, and consequently the amount of pressure which is applied to the printing plate, is determined by the adjustment of a stop screw 47 which threadedly engages the frame and the tip of which engages a stop surface 48 on the arm 41 of the lever.

For the purpose of fine adjustment of the pressure of roller 35 with respect to the distributor roller 31 and plate 11, an eccentric bushing 50 having shallow eccentricity is interposed between the mounting ring 46 and lever 40, the phase of the eccentric bushing being determined by a worm wheel adjustment including a worm 51 having an adjusting knob 52.

For the purpose of supporting the intermediate roller 25 between respective throw-off and working positions, a second throw-off lever 60 is provided which is arranged in the effective path of movement of the throw-off lever 40 and subject only to the final portion of movement of the latter in the direction of throw-off. The lever 60 is swingable about a shaft 61 at its upper end journaled in the frame 15. The lower end 62 is engaged by a biasing spring 63 which urges the lever 60 clockwise into working position, with the spring force being established by the setting of an adjusting screw 64 which is interposed between the spring and the frame of the device. An adjustable stop in the form of a screw 65, which engages a stop surface 66 on the lever, determines the running position of the roller 25 with respect to the roller 31. Fine adjustment of the roller position is determined by an eccentric bushing 70 which is interposed between the lever 60 and the shaft 61 upon which it is mounted, the phasing of bushing being determined by an adjustable worm 71 under the control of an adjusting knob 72.

For swinging the lever 60 clockwise only during the final portion of the throw-off movement of the lever 40, a cam 80 is interposed between those two members, being secured to the right-hand edge of the lever 40 and engaging a stop or abutting surface 81 on the lever 60. It is one of the features of the invention, as illustrated in FIG. 2, that under the condition of throw-off the line of action of the reaction force F between the levers originating in the biasing spring 63 is directed along a line 82 which intersects the axis of rotation 45 of the lever 40. Since the reaction force intersects the lever axis it does not have any moment arm with respect to the lever 40 and the reaction force does not, therefore, have to be resisted by the power actuator 43 during conditions of throw-off. Thus, where the actuator 43 is of the pneumatic type and where a leak may exist in the line, the biasing spring 63 will not have the effect of constantly urging the actuator in the direction of its working position. This makes it possible to use an actuator of the type which applies only a momentary thrust to achieve throw-over between its respective end positions.

The operating sequence during a typical throw-off cycle may be reviewed as follows: The mechanism, initially, will be understood to be in the condition of FIG. 1, with a film of water being fed through the series of rollers to the surface of the printing plate. When throw-off is desired, either momentary or for extended shut down, the actuator 43 is energized in the direction to retract the rod 44, thereby rocking the throw-off lever 40 clockwise about its axis 45. During the initial portion ot the movement, separation will immediately take place between the form roller and the plate. Contact between the form roller and the distributor roller 31 may persist just long enough for the form roller to undergo one or more revolutions to establish an optimum film on the surface of the form roller following which the form roller disengages itself from the surface of the distributor roller 31, such disengagement coming about by the fact that the center of rocking movement 45 of the lever 40 is spaced from the fixed center of rotation of the distributor roller, that is, the center of shaft 32.

The rocking movement of throw-off lever 40 mentioned thus far has had no effect upon the throw-off lever 60. However, during the final portion of the clockwise movement of the lever 40, the cam 80 thereon engages the cooperating surface 81 at the edge of the lever 60, causing the latter to rock counterclockwise through a small angle against the restoring force of the spring 63. The initial portion of throw-off movement of the lever 60 causes the intermediate roller 25 to disengage itself from the distributor roller 31, leaving the latter with an adequate film of water. As the final event of throw-off, the intermediate roller 25 is wipingly moved out of engagement with respect to the fountain roller 21, the intermediate roller receiving an adequate film of water, before final disengagement. As a result, all of the rollers may be separated from one another and charged with a film of water of optimum thickness. It will be assumed that the distributor roller 31 continues to operate at "press speed" and that the fountain roller 21 continues to be driven by its drive 24.

Thus, where the rollers are restored to the working condition of FIG. 1 after only a brief period of throw-off, and before substantial evaporation has taken place, all of the rollers will be in moisture transmitting condition to take up the furnishing of water to the plate where they left off and free of any possibility of flooding.

It is to be noted that the charging of the individual rollers with water incident to throw-off and the re-engagement of the rollers in water transmitting relation is brought about automatically by a single energization and de-energization of the actuator 43 without care or attention on the part of the operator. This is to be distinguished from the prior patent mentioned above which requires separate actuators for separate portions of the rollers in the water train, which actuators must be operated, with exercise of skill, in a coordinated fashion.

Figure 3:
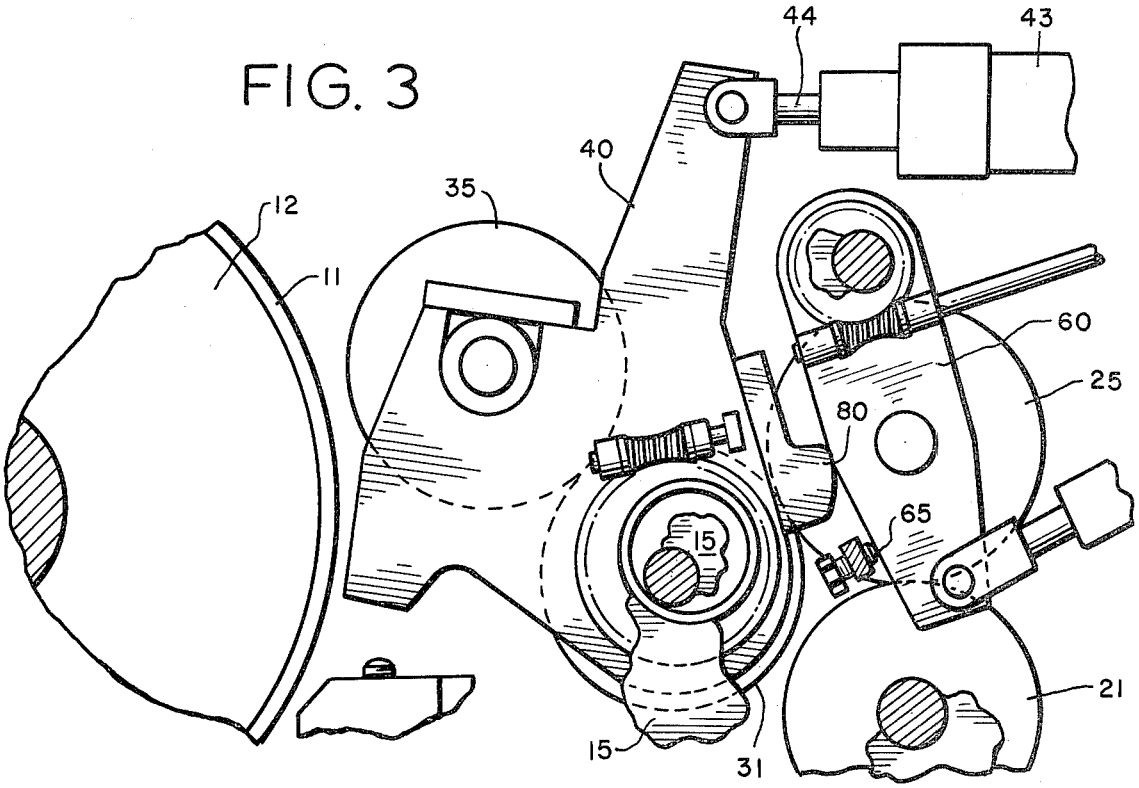
FIG. 3 is a stop motion view showing engagement of the intermediate roller with the fountain roller and distributor roller during the initial portion of the restoration stroke of the actuator.

It is one of the features of the present invention that an assured film of water exists on the form roller 35 at the time that the form roller is brought into contact with the plate regardless of the length of the period of throw-off and even where the water on the rollers has completely evaporated. This will be made clear upon considering the stop motion views, FIGS. 3 and 4. FIG. 3 shows the condition of the rollers a moment after the actuator 43 has been energized in a direction to restore the working condition, that is, energized in a direction to impart counterclockwise movement to the throw-off lever 40. The initial portion of the movement releases the throw off lever 60, allowing the intermediate roller 25 first to come into pressure contact with the fountain roller 21 and then into seated contact with the distributor roller 31, with the final position being determined by the setting of the stop 65. This completes a water feed path from the fountain roller 21 to the distributor roller 31, causing the latter to be wetted to the proper degree.

Figure 4:
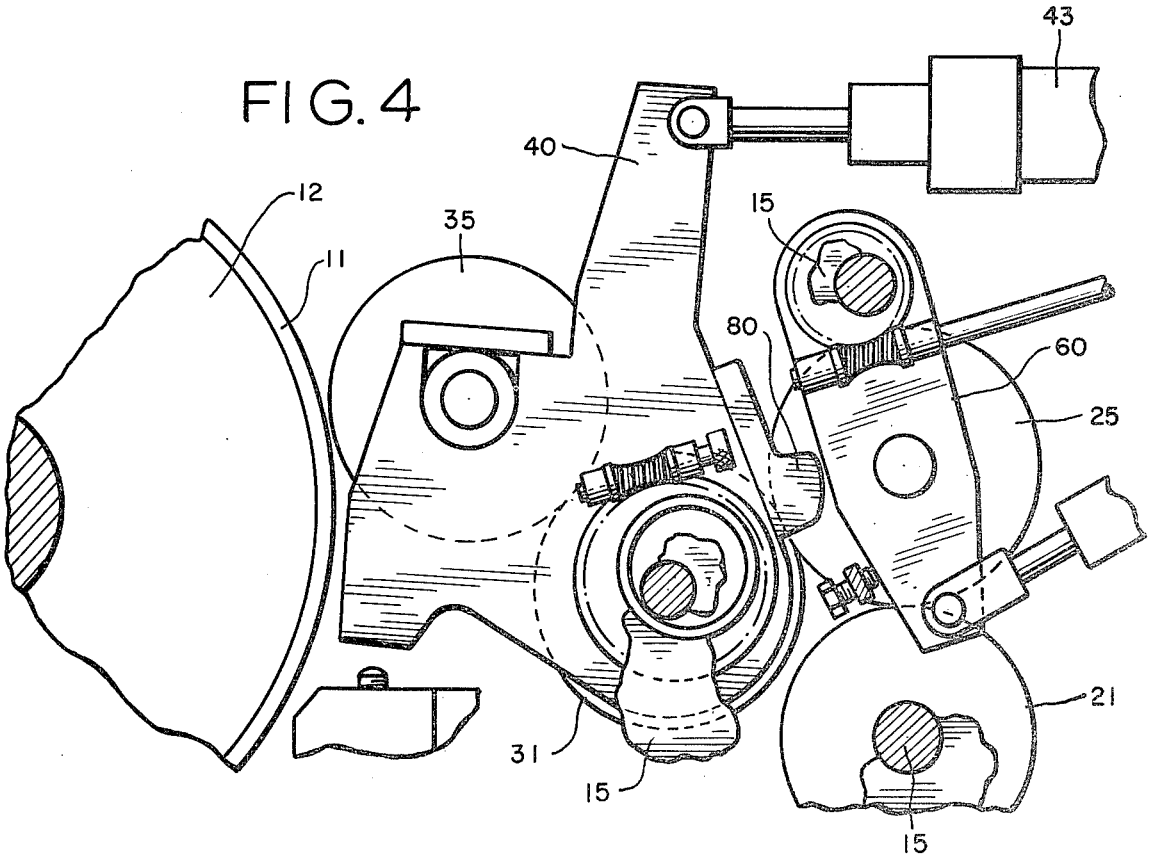
FIG. 4 is a further stop motion view taken a brief moment following that of FIG. 3 and showing the form roller in contact with the distributor roller for rewetting of the form roller prior to contact of the form roller with the plate.

Shortly thereafter, as the plunger 44 of the actuator continues its outward movement, the distributor roller 31, with a film freshly formed thereon, is pressed into the surface of the form roller 35, with the two undergoing one or more revolutions together for re-formation of the film on the form roller prior to engagement with the plate, which is the condition illustrated in FIG. 4.

The final portion of the outward movement of the actuator plunger results in the seating of the form roller 35, with its proper degree of moisture, and prerotated by the distributor roller 31, into contact with the surface of the printing plate 11. The above sequence, as stated, assures that the form roller 35 is wetted to proper degree, avoiding either flooding or dryness, and prerotated, as it is brought into its working relation to the plate, the condition which is shown in FIG. 1.

While the timing and sequence of breaking of contact during the throw-off stroke, and the timing and sequence of engagement, is automatically determined by a simple triggering of a power actuator 43 in one direction or the other, it will be understood that the present invention is not limited to use of a power actuator and manual means, for example a single handle coupled to the lever 40, may, if desired, be used; accordingly, the term "actuator" is not limited to a powered device. However, where manual actuation is used the operator should be instructed to swing the lever 40 smartly and consistently between its end positions, in imitation of a powered device, in order to insure the precise timing which has been described.

While it is one of the features of the present mechanism that the throw-off lever 60 is located in the path of final movement of the throw-off lever 40, it will be understood that what is referred to its the "effective" path of final movement. It will be understood, for example, that the cam 80, instead of directly engaging the lever 60, may, and normally will, engage a cam follower secured thereto. It will be further understood that the illustrated levers and associated elements will be repeated at both sides of the frame.

Comparing the above mechanism with that shown in, say, FIG. 1 of the prior patent it is apparent that a large degree of simplification and economy have been achieved accompanied by precise and automatic sequencing which achieves the proper water feed conditions regardless of whether throw-off is momentary or for an extended period of time upon simple triggering of the actuator and without exercise of care or skill on the part of the operator.

For the sake of easy understanding it has been temporarily assumed in the above discussion that the rollers are thrown between a pressurized "working" condition in which each roller exerts pressure against its neighbor and an alternate throw-off condition in which each roller is separated from its neighbor. However, it is one of the features of the present invention, in its preferred aspect, that under the throw-off condition pressure is relieved at the engaged surfaces of all of the rollers but all of the rollers are not moved out of touching contact with one another. More specifically, and as shown in FIG. 2, the form roller 35 is completely disengaged from the plate by a rather wide spacing and the intermediate roller 25 is physically separated, and spaced from, the cooperating distributor roller 31. However, light "kissing" contact is permitted to occur between the form roller 35 and distributor roller 31 on the one hand and between the intermediate roller 25 and the fountain roller 21 on the other hand. By "kissing" contact is meant that the pressure between the rollers is reduced, by relative shifting of the roller centers, to an extremely low value, a value which is sufficient to cause the pairs of rollers to rotate idly together free of any indenting effect. That is, under the preferred condition of throw-off, the form roller 35 will be rotated in idle, substantially pressureless, contact with the associated distributor roller 31 as the latter continues to be driven from the drive 34. Similarly, under the throw-off condition, the intermediate roller 25 will tend to be idly rotated by substantially pressureless "kissing" engagement with the fountain roller 21, the latter being driven by the drive 24.

Such light "kissing" contact insures that the residual moisture which exists upon the surfaces of the rollers at the moment of cut-off will persist in the form of a film and will not have opportunity to contract into droplets, by reason of surface tension, which droplets have a degrading effect upon the initially printed copies when the fountain is subsequently restored to its running condition in which pressure exists between all of the rollers in the series.

Restricting the separating movement between the form roller 35 and distributor roller 31 and between the intermediate roller 25 and the fountain roller 21 during throw-off in order to maintain the "kissing" engagement discussed above is a matter well within the skill of the art. That is to say, in FIG. 2 the rollers 35, 31 and rollers 25, 21 are retained in substantially pressureless contact. It will be appreciated by one skilled in the art that the reduction in axial separation required to retain "kissing" contact between the selected rollers under the throw-off condition is a matter of geometrical adjustment, primarily a slight shifting of roller centers and slight adjustment of eccentricity. Thus, to reduce the separation between the rollers 35, 31 for a given swing of the arm 42 to retain "kissing" contact, the "throw" between the centers 45, 32 may be reduced by rotation of bushing 50 while to retain substantially pressureless contact between the rollers 25, 21 the eccentric bushing 70 may be similarly rotated.

It is one of the features of the invention, in its preferred form, that the intermediate roller 25 operates at two different speeds in the running and throw-off conditions. During normal running (FIG. 1) the roller 25 is driven at press speed, with slippage between the roller and the fountain roller. However, during throw-off, the substantially pressureless contact between the intermediate roller 25 and the fountain roller 21 is, nevertheless, sufficient for the roller 25 to operate at the peripheral speed of the fountain roller which continues to be driven, at slower than press speed, by the drive 24. (FIG. 2).

In contrast, a fountain roller 35 continues to operate at press speed during both running and throw-off conditions. In the latter condition the "kissing" contact suffices to cause the form roller to operate at press speed. In any event, both of the rollers 35, 25 being constantly pre-rotated, and with the water film being constantly reformed thereon are in a position to be restored to running condition by snap action of the actuator 43 without the usual time delay of conventional dampening systems.

What we claim is:

1. In a dampening system for a printing press having a lithograph plate, plate cylinder and drive therefore, the combination comprising a frame, a fountain containing dampening fluid, a fountain roller, means for driving the fountain roller at a relatively slow speed, an intermediate roller, a distributor roller, means for driving the distributor roller at press speed, and a form roller, said rollers occupying working positions under normal running conditions in serial pressure engagement with one another for conveying a film of dampening fluid to the plate, means including a form roller throw-off lever pivoted to the frame and mounting the form roller for establishing a throw-off position for the form roller in which the form roller is totally disengaged from the plate and in which the form roller retains "kissing" contact with the distributor roller, means including an intermediate roller throw-off lever pivoted to the frame and mounting the intermediate roller for establishing a throw-off position in which the intermediate roller is totally disengaged from the distributor roller while retaining "kissing" contact between the intermediate roller and the fountain roller, an actuator having linkage coupling the same to both of the throw-off levers for moving them between respective working and throw-off positions, the linkage including sequencing means so that when the form roller and intermediate roller are restored by the linkage to their working positions contact is made last between the form roller and the plate, the pivots of the levers each having means providing limited orbital adjustment for adjusting the "kissing" contact to a substantially pressureless condition serving to ensure that during throw-off residual fluid on the surfaces of the rollers will be maintained in the form of an evenly distributed film free of contraction into droplets by reason of surface tension.

2. The combination of claims in claim 1 in which the intermediate roller throw-off has a spring acting thereon for biasing the intermediate roller toward its working position and in which the sequencing means is in the form of camming surfaces on the levers, the region of contact at the camming surfaces being so located that under conditions of throw-off the reaction force at the camming surfaces resulting from the spring passes substantially through the center of rocking movement of the form roller throw-off lever with the result that such reaction force is substantially isolated from the actuator.

* * * * *